US011745255B2

(12) United States Patent
Rollinger et al.

(10) Patent No.: US 11,745,255 B2
(45) Date of Patent: Sep. 5, 2023

(54) METHOD FOR MANUFACTURING A CERAMIC CORE FOR MANUFACTURING TURBOMACHINE VANES

(71) Applicant: SAFRAN, Paris (FR)

(72) Inventors: Adrien Bernard Vincent Rollinger, Moissy-Cramayel (FR); Alice Marie Lydie Agier, Moissy-Cramayel (FR); Gael Philippe François Battistoni, Moissy-Cramayel (FR)

(73) Assignee: SAFRAN, Paris (FR)

( * ) Notice: Subject to any disclaimer, the term of this patent is extended or adjusted under 35 U.S.C. 154(b) by 0 days.

(21) Appl. No.: 17/753,292

(22) PCT Filed: Aug. 27, 2020

(86) PCT No.: PCT/FR2020/051507
§ 371 (c)(1),
(2) Date: Feb. 25, 2022

(87) PCT Pub. No.: WO2021/038174
PCT Pub. Date: Mar. 4, 2021

(65) Prior Publication Data

US 2022/0288671 A1 Sep. 15, 2022

(30) Foreign Application Priority Data

Aug. 30, 2019 (FR) ..... 1909534

(51) Int. Cl.
*B22C 9/10* (2006.01)
*B22C 7/02* (2006.01)

(52) U.S. Cl.
CPC ..... *B22C 9/103* (2013.01); *B22C 7/02* (2013.01)

(58) Field of Classification Search
CPC .. B22C 7/02; B22C 9/10; B22C 9/103; B22C 9/108; B22C 21/14
See application file for complete search history.

(56) References Cited

U.S. PATENT DOCUMENTS

2009/0285684 A1 11/2009 Pinero et al.
2015/0132139 A1* 5/2015 Tran ..... B22C 7/02 164/45
2018/0304345 A1 10/2018 Slavens et al.

FOREIGN PATENT DOCUMENTS

CA 2872066 A1 11/2013
CN 101468384 A 7/2009
(Continued)

OTHER PUBLICATIONS

French Search Report issued in French Application FR 1909534 dated Mar. 16, 2020 (2 pages).
(Continued)

*Primary Examiner* — Kevin P Kerns
*Assistant Examiner* — Steven S Ha
(74) *Attorney, Agent, or Firm* — Bookoff McAndrews, PLLC

(57) ABSTRACT

A method for manufacturing a ceramic core blank intended for the manufacture of hollow turbomachine blades using the technique of lost wax casting, the blank being manufactured by additive manufacture and comprising at least one first part intended to form the cavities of the hollow blades and at least one second part configured to allow the positioning of the core in a wax mold, the second part and the first part being positioned and held with respect to one another by means of a junction portion interposed between the first part and the second part, at least one through orifice extending through the second part, the junction portion and the first part, a first end of the through orifice opening to an
(Continued)

outer face of the second part, and a second end of the through orifice opening to an outer face of the first part.

14 Claims, 2 Drawing Sheets

(56) References Cited

FOREIGN PATENT DOCUMENTS

| | | | |
|---|---|---|---|
| CN | 104918731 | A | 9/2015 |
| CN | 105728656 | A | 7/2016 |
| CN | 107199312 | A | 9/2017 |
| CN | 107405687 | A | 11/2017 |
| CN | 108698117 | A | 10/2018 |
| CN | 109482819 | A | 3/2019 |
| FR | 2889088 | A1 | 2/2007 |

OTHER PUBLICATIONS

International Search Report and Written Opinion issued in International Application PCT/FR2020/051507 dated Oct. 16, 2020 (10 pages).
Office Action issued in corresponding Chinese Application No. 202080060732.3 dated Apr. 13, 2023.

* cited by examiner

[Fig. 1]
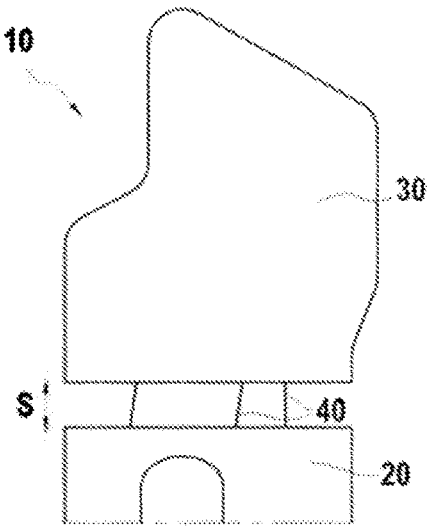
[Fig. 2A]
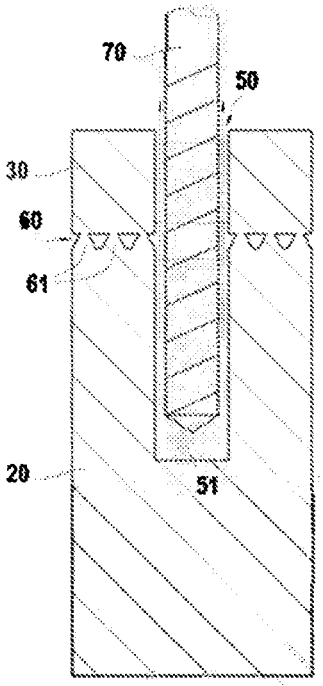
[Fig. 2B]
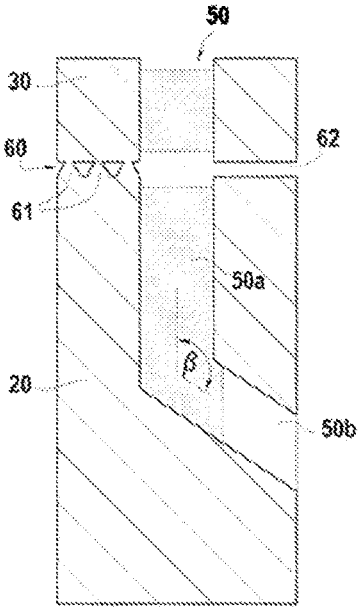

[Fig. 3]
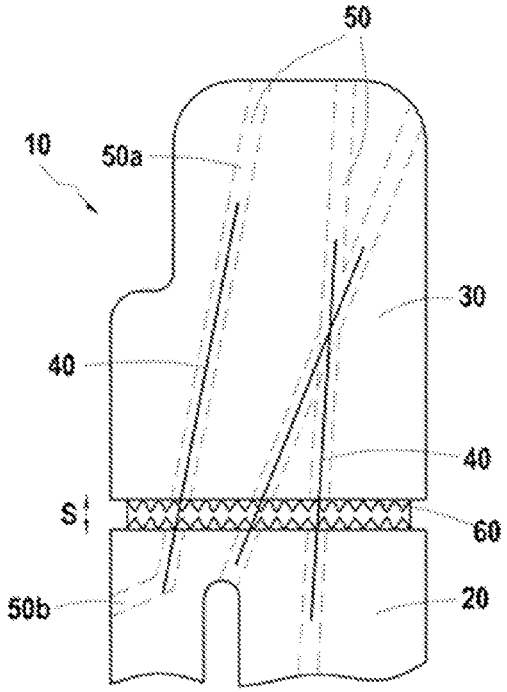
[Fig. 4]
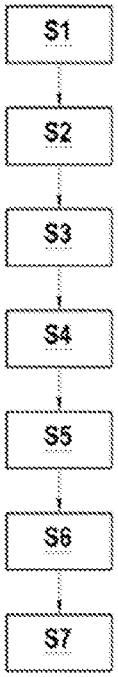

METHOD FOR MANUFACTURING A CERAMIC CORE FOR MANUFACTURING TURBOMACHINE VANES

CROSS-REFERENCE TO RELATED APPLICATIONS

This patent application is the U.S. National Stage entry under 35 U.S.C. § 371 of International Patent Application No. PCT/FR2020/051507, filed on Aug. 27, 2020, which claims the benefit of priority to French Patent Application No. 1909534, filed on Aug. 30, 2019, the entirety of which is incorporated herein by reference.

TECHNICAL FIELD

The present disclosure relates to the field of the manufacture of turbomachine blades using the technique of lost wax casting, particularly the manufacture of ceramic cores used for the manufacture of these blades using this technique. In particular, the present disclosure relates to a method for manufacturing such a ceramic core, for the manufacture of hollow turbomachine blades using the technique of lost wax casting.

PRIOR ART

Blades present in turbomachines, particularly turbine blades, low pressure for example, generally include inner cavities necessary for the cooling of these blades. During the manufacture of the blades using the technique of lost wax casting, these cavities are formed, prior to the formation of the wax mold, by means of ceramic cores, the shape of which corresponds to the desired shape of the cavities in the final part. A portion of such a core 10 is shown schematically in FIG. 1. These ceramic cores generally comprise a first part 20, the first part 20 being a functional part corresponding to the future cavities of the blade and having their shape (only the upper end of the first part, corresponding to the tip, or head of the blade, is visible in FIG. 1), and a second part 30, called a dome for example, serving as a core 10 holding region. More precisely, during the pour of the wax around the core 10, or the removal of the wax, the core 10 is held in fixed position with respect to the ceramic mold by means of a non-functional portion of this second part 30. The second part 30 also comprises a functional portion, at its lower end, serving in particular to form the contour of the bathtub of the blade at the end of the manufacturing process thereof.

In order for the metal to be poured around the core, particularly around the upper portion of the first part 20 of the core 10 visible in FIG. 1, to form the cavities of the blade, the first part 20 must be spaced from the second part 30, while being secured to the latter and held by the latter. To this end, thin rods 40 are arranged between these two parts, and hold these parts secured to one another and fixed with respect to one another, while leaving a space S between these two parts. Thus, the poured metal penetrating this space S between these two parts will correspond to the bottom wall of the blade tip bathtub, at the end of the blade manufacturing process.

In conventional injection techniques, the rods 40 are directly placed in a mold and a ceramic paste is injected around them. However, the complexity of certain ceramic cores necessitates suitable manufacturing techniques, such as additive manufacture. This technique, in which the core is constructed layer by layer, does not allow the insertion of rods during manufacture. It is therefore necessary to provide orifices in the core during the additive manufacture of the latter, in order to be able to insert rods into it a posteriori. Nevertheless, the insertion of these rods necessitates prior cleaning, i.e. emptying the holes provided for this purpose of the excess ceramic matter which is deposited there during the printing of the core.

However, the emptying of these orifices is complex due to the small diameter and the great length of the latter. This step of cleaning the orifices also leads to frequent deteriorations of the cores, and to numerous rejections of these cores. Current tools and techniques do not allow accomplishing this operation in an effective manner.

DISCLOSURE OF THE INVENTION

In order to at least partly mitigate the disadvantages mentioned above, the present disclosure relates to a method for manufacturing a ceramic core blank for the manufacture of hollow turbomachine blades using the technique of lost wax casting, the blank being manufactured by additive manufacture and comprising:

- at least one first part for forming the cavities of the hollow blades,
- at least one second part configured to allow the positioning of the core in a wax mold, the second part and the first part being positioned and held with respect to one another by means of a junction portion interposed between the first part and the second part,
- at least one through orifice extending through the second part, the junction portion and the first part, a first end of the through orifice opening to an outer face of the second part, and a second end of the through orifice opening to an outer face of the first part.

It will be understood that the junction portion is formed at the same time as the first part and the second part during additive manufacture, and therefore comprises the same material as these parts. The junction portion can be a 3D printed manufacturing artifice, called a "printing support," forming a junction portion between these two parts during printing. In particular, the junction portion allows holding these two parts secured to one another and fixed with respect to one another temporarily, prior to the insertion of the rods. Contact between the junction portion and the first and second parts can be discontinuous. For example, the junction portion can include a plurality of studs and spikes interposed between the two parts. This configuration allows facilitating the subsequent withdrawal of this junction portion, after the placement of the positioning rods.

What is meant by "blank" is an intermediate state of the core during its manufacture, particularly before the insertion of the rods. The manufacture of the blank by additive manufacture is accomplished in such a manner that the blank thus obtained comprises the first part, the second part and the junction portion. In addition, this manufacture provides for the presence of at least one through orifice. By "through" or "opening" is meant that the orifice opens on either side of the blank, by opposition to a blind hole comprising a bottom. In particular, the orifice passes through the second part, the junction portion and the first part, by opening at each of its ends to a region exterior to the core blank, around the latter.

This configuration allows facilitating the cleaning of the through orifice. In fact, at the end of the manufacture of the blank by additive manufacture, non-solidified residues of the ceramic paste remain in the orifice, due in particular to the high viscosity of this paste.

Cleaning allows removing these residues, in order to allow the insertion of the positioning rod. However, the configuration of the present disclosure allows easily expelling these residues by an opening end of the orifice, by applying a pressure, for example by injecting a pulsed mixture of solvent and air, at the other opening end of the orifice. It is thus possible to effectively accomplish the cleaning of the orifice, by dispensing with the use of unsuitable tools such as drills, thus limiting the reject rate of the cores.

Moreover, according to the prior art, the portion of the orifice passing through the second part has a great length, the length of the drills not allowing piercing/cleaning this portion of the orifice in a single step. It is then necessary to print this second part in two parts, in order to clean the orifice in two steps, then re-bond the two parts together. The presence of a through orifice according to the present disclosure allows dispensing with this disadvantage, thus simplifying the method of manufacturing the core.

In certain embodiments, the junction portion comprises a passage putting into fluid communication the through orifice and a space outside the core blank.

This passage allows facilitating the cleaning of the through orifice. In fact, when the cleaning of the orifice is carried out by injecting a solvent, for example, at the two ends of the orifice, the residues of ceramic paste dissolved in the solvent can be removed through this passage.

In certain embodiments, the through orifice comprises a first rectilinear portion extending from the first end, and a second rectilinear portion having an angle less than 180° with respect to the first rectilinear portion, and extending from the second end.

Preferably, the first rectilinear portion extends through the second part from the first end until the junction portion, through the junction portion and a part of the first part. The second rectilinear portion extends in the first part between the end of the first rectilinear portion located in the first part, and the second end. In other words, the first rectilinear portion and the second rectilinear portion form together an elbow having an angle less than 180°, this angle preferably being located in the first part. The length of the first rectilinear portion can be determined depending on the length of the positioning rod before being inserted. The presence of this elbow allows shortening the length of the second rectilinear portion of the orifice, and allows in particular reaching the exterior of the core.

In certain embodiments, the angle between the first and the second rectilinear portion is greater than or equal to 100°, preferably comprised between 110° and 120°.

These values allow limiting the risk, during the cleaning step, that residues of ceramic paste would remain blocked in the elbowed part of the orifice, if the angle between the first and the second rectilinear portion were too small. These values also allow limiting the volume of the through orifice. Thus, these values between the first and the second rectilinear portion allow facilitating the operation of cleaning the orifice.

In certain embodiments, the diameter of the first rectilinear portion of the through orifice is comprised between 0.15 and 0.3 mm.

The diameter of the first rectilinear portion can be determined depending on the diameter of the positioning rod before being inserted. Preferably, a clearance must exist between the positioning rod and the orifice.

In certain embodiments, the diameter of the second rectilinear portion of the through orifice is comprised between 0.4 and 0.6 mm.

The through orifice can have a circular cross section. These values allow facilitating the insertion of the positioning rods and the cleaning of the orifices. In fact, diameters that are too great would not be suited for cleaning techniques such as injection of pulsed air and/or solvent, and would make this injection ineffective. The operation of capping the orifices would also be longer, more complex and would demand a large quantity of ceramic paste for capping these orifices. Moreover, diameters that are too great would harm the mechanical properties of the core and would not allow accurate positioning of the positioning rods. On the other hand, diameters that are too small would prevent the insertion of the positioning rods.

The present disclosure also relates to a method for manufacturing a ceramic core for the manufacture of hollow turbomachine blades using the technique of lost wax casting, the method comprising a step of manufacturing a blank by the method according to any one of the preceding embodiments, and also comprising, after the manufacture of the blank:

cleaning the through orifice, inserting at least one positioning rod into the through orifice, capping the through orifice, eliminating the junction portion.

At the end of the manufacture of the blank by additive manufacture, non-solidified residues of ceramic paste remain in the orifice. Cleaning allows removing these residues, in order to allow the insertion of the positioning rod. Moreover, the elimination of the junction portion can be carried out by sintering the ceramic by means of a suitable tool, for example a high-precision grinder allowing freeing the space between the first part and the second part.

In certain embodiments, the cleaning of the through orifice is accomplished by an injection of pulsed air and/or of a solvent into at least one end of the orifice.

Pulsed air only, a solvent only, or a mixture of the two can be used for the cleaning of the orifice. The pulsed air and/or the solvent injected at one of the ends of the orifice are removed, while carrying with it the residues of ceramic paste, by the other end of the orifice and/or by the passage into the junction portion. The pulsed air and/or the solvent injected at the two ends of the orifice, simultaneously or not, are removed, while carrying with it the residues of ceramic paste, by passage into the junction portion. These cleaning techniques have the advantages of being easy to implement, low in cost and considerably limiting the risk of breaking the ceramic cores during cleaning of the orifices. This technique further has the advantage of being rapid, and does not add an additional step, unlike the use of a drill to clean the orifices according to the prior art. In fact, the cleaning of the orifices using pulsed air and/or solvent can be accomplished at the same time as the cleaning of the core.

In certain embodiments, the cleaning of the through orifice is accomplished by inserting mechanically a cleaning means into at least one end of the orifice.

This technique of mechanical insertion of a cleaning means can be accomplished alone or in addition to pulsed air and/or solvent.

In certain embodiments, the cleaning step and the insertion step are accomplished simultaneously.

According to this embodiment, the fact of inserting the rod at one end of the through orifice allows pushing the ceramic residues, these residues being able to escape by the other end of the orifice. The rod itself thus acts as a mechanical cleaning means.

In certain embodiments, the positioning rods are rods of alumina.

Alumina rods are a ceramic material having the advantage of being resistant to the same thermal stresses as the rest of the part and having the same chemical properties on shake-out. They also allow a high resistance to tension/compression to provide the dimensional stability of the thickness of the bottom of the bathtub, as well as a solid attachment between the first and the second part. Alternatively, rods comprising molybdenum can be used.

In certain embodiments, the capping of the through orifice is accomplished by applying a ceramic paste to the two ends of said orifice.

The capping of the two ends of the orifice allows avoiding a part of an undesired infiltration of the wax out of the wax mold and, on the other hand, obtaining a uniform surface condition of the ceramic core, in particular on the first part. This allows ensuring that the final part does not have irregularities.

In certain embodiments the method comprises, after capping, a hardening step allowing hardening the ceramic paste.

The hardening step comprises, for example exposure under a UV lamp allowing the ceramic paste used for capping to harden. This allows improving the overall rigidity of the ceramic core, when its manufacture is finished.

In certain embodiments, prior to their insertion, the positioning rods are coated with ceramic adhesive.

The present disclosure also relates to a ceramic core blank for the manufacture of hollow turbomachine blades using the technique of lost wax casting, and comprising:

- at least one first part for forming the cavities of the hollow blades,
- at least one second part configured to allow the positioning of the core in a wax mold, the second part and the first part being positioned and held with respect to one another by means of a junction portion interposed between the first part and the second part,
- at least one through orifice extending through the second part, the junction portion and the first part, a first end of the through orifice opening on an outer face of the second part, and a second end of the through orifice opening on an outer face of the first part.

The present disclosure also relates to use of the ceramic core obtained by the method according to any one of the embodiments of the present disclosure, for the manufacture of turbomachine hollow turbine blades using the technique of lost wax casting.

BRIEF DESCRIPTION OF THE DRAWINGS

The invention and its advantages will be better understood upon reading the detailed description given hereafter of the different embodiments of the invention given by way of non-limiting examples. This description refers to the pages of appended drawings, in which:

FIG. 1 shows schematically a plan view of a portion of a ceramic core intended to be used in the manufacture of hollow turbomachine blades using the technique of lost wax casting, FIG. 2A shows schematically a technique for cleaning an orifice according to the prior art, and FIG. 2B shows schematically a technique of cleaning an orifice according to the present disclosure, FIG. 3 shows a schematic transparent view of a portion of a ceramic core of the present disclosure, FIG. 4 is a diagram shown the method of manufacturing a ceramic core according to the present disclosure.

DESCRIPTION OF THE EMBODIMENTS

FIGS. 2A and 2B show schematically samples of a ceramic cored, in the form of test pieces, allowing illustrating the cleaning of an orifice of the core. FIG. 2A shows schematically a technique for cleaning an orifice 50 according to the prior art. The orifice 50 is non piercing. The hashed part represents the ceramic core, more precisely the polymerized paste forming the ceramic core. The latter comprises a first part 20, a second part 30 and a junction portion 60. The greyed part shows the non-polymerized ceramic paste remaining in the orifice 50 after the printing of the core blank.

During additive manufacture, the core blank is made layer by layer, beginning with the first part 20 for example, then the junction portion 60, then the second part 30, while providing for the presence of the orifice(s) 50. The junction portion 60 has a toothed shape, limiting the contact surface between the junction portion 60 and the first part 20 and/or the second part 30. The junction portion 60 can thus comprise a plurality of teeth 61, in the form of spikes or of studs, interposed between these two parts.

According to the specific case illustrated in FIG. 2A, the orifice 50 is non piercing and comprises a bottom 51. The operation of cleaning the orifice is carried out, for example by means of a drill 70, its passage into the orifice 50 allowing removing the paste. A technique of this type causes the deterioration or the breakage of many ceramic cores.

FIG. 2B shows schematically a technique for cleaning an orifice 50 according to the present disclosure. Unlike the specific case according to the prior art, the orifice 50 is piercing. More precisely, the orifice 50 comprises a first rectilinear portion 50*a* extending through the second part 30, the junction portion 60 and the first part 20, and a second rectilinear portion 50*b* extending through the first part 20 from the end of the first rectilinear portion 50*a* and opening on an outer face of the first part 20. The first rectilinear portion 50*a* is preferably longer than the second rectilinear portion 50*b*, and is intended to receive a positioning rod. The angle β between the first and the second rectilinear portion 50*a*, 50*b* is less than 180°, and greater than or equal to 100°, preferably comprised between 110° and 120°.

During additive manufacture, a passage 62 is provided in the junction portion 60. This passage 62 can be an orifice or a local absence of teeth 61, allowing the orifice 50 to be put into fluid communication with a region outside the ceramic core, and surrounding it. The passage 62 allows facilitating the cleaning operation of the orifice 50. In fact, at the end of additive manufacture, the cleaning of the orifice 50 can be carried out by injecting pulsed air at one or both ends of the orifice 50. The pressure exerted at the ends of the orifice 50 allows the removal of the non-polymerized paste present in the orifice, through the passage 62 of the junction portion 60 (see arrows in FIG. 2A). In place of the pulsed air, a solvent can be injected, or a mixture of air and of solvent. Alternatively, a suitable cylindrical tool can be used to push the paste, in addition to or in place of the air and/or of the solvent.

FIG. 3 shows a schematic view of a part of the ceramic core 10 according to the present disclosure, accomplished by additive manufacture, comprising a first part 20, a second part 30, and a junction portion 60. The first part 20 has the shape of the cavities that it is desired to obtain at the end of the manufacture of the turbine blade. In FIG. 3, only the upper end of the first part 20, corresponding to the upper end, or tip, of the blade is visible. The second part 30 or dome, allows the retention of the ceramic core 10 during the manufacture of the wax model, and during the pour of metal into a ceramic shell mold. The first part 20 and the second part 30 are spaced from one another by a distance S comprised between 0.4 and 1.4 mm. This spacing and this positioning of the first part 20 with respect to the second part 30 are provided, and the end of the manufacture of the core blank, by the junction portion 60. After the elimination of the junction portion 60, the space S remaining between these two parts allows the formation of the bathtub at the tip of the blade, during the pouring of metal infiltrating into this space.

In this example, three through orifices 50 extend through the second part 30, the junction portion 60 and the first part 20. Each of these orifices 50 comprises a first rectilinear portion 50*a* opening on an outer face of the second part 30, and a second rectilinear portion 50*b* (of which only one is visible in FIG. 3) opening to an outer face of the first part 20. A positioning rod 40 is inserted into each of these orifices 50. These positioning rods 40 can be rods of alumina, and can have a length of 13 mm and a diameter of 0.6 mm. Nevertheless, these dimensions are not limiting and can be modified depending on the considered geometry of the core.

The rest of the description describes a method for manufacturing a ceramic core 10 according to the present disclosure, with reference to FIG. 4.

A first step in the manufacturing of a ceramic core 10 comprises the manufacture of a core blank by additive manufacture (step S1). The blank comprises the first part 20, the junction portion 60 and the second part 30. Additive manufacture provides for the presence of through orifices 50, and of the passage(s) 62 in the junction portion 60.

At the end of the manufacture of the blank, the orifices 50 are cleaned i.e. emptied of residues of non-polymerized ceramic paste remaining in the orifices 50 (step S2). To this end, pulsed air and/or solvent, for example, is injected in the ends of the orifices 50. The residual paste is thus removed by the passage 62 of the junction portion 60.

A positioning rod 40 is then inserted into each through orifice 50 (step S3). More precisely, a positioning rod 40 is inserted into the first rectilinear portion 50*a* of each through orifice. The rods 40 are inserted from the top, i.e. by the end of the orifice 50 opening on an outer face of the second part 30, and driven into the orifice 50 so as to extend both in the second part 30 and in the first part 20. The rods 40 can be previously coated with ceramic adhesive. This adhesive solidifies during the thermal treatment described below, and allows optimal coating of the rod.

After the placement of the positioning rods 40 in the orifices 50, the latter are capped (step S4). This capping is carried out by means of a ceramic paste, so as to obtain a smooth surface condition on the outer faces of the first and second parts 20 and 30. This allows subsequently avoiding surface irregularities on the wax model, and on the final part. The capping is followed by a step of hardening the ceramic paste, allowing solidifying the paste added in step S4 (step S5). This step can be carried out according to the properties of the paste, depending on whether it is, for example, photosensitive or heat-sensitive, by means in particular of a UV light source or a heat source. According to this embodiment, the hardening step is accomplished by exposure to UV light. It will be noted that after solidification of the ceramic paste, the core 10 can also follow a heat treatment step comprising debonding and sintering.

The method finally comprises the elimination of the junction portion 60 (step S6). This elimination is facilitated by the toothed shape of the junction part 60, and can be accomplished by any suitable tool which can be inserted between first part and the second part. At the end of this step, the first part 20 and the second part 30 are held to one another and positioned with respect to one another solely by the positioning rods 40.

The ceramic core 10 thus obtained can then be used in the manufacture of hollow turbomachine blades using a technique of lost wax casting. In particular, the ceramic core 10 can be arranged in a wax mold, while being held by the second part 30 to form the wax model having the shape of the final part, with cavities formed by the first part 20 of the ceramic core 10. The wax model is then plunged several times into a slurry in order to form the ceramic mold. After elimination of the wax, the molten metal is poured into the ceramic mold and around the ceramic core, the latter again being held in fixed position by means of the second part 30. Finally, the ceramic mold and the ceramic core 10 are then eliminated by shaking-out, in order to obtain the final part. It will be noted that the elimination of the ceramic also comprises the elimination of the alumina positioning rods 40, withdrawn during shaking-out, then leaving small orifices through the bathtub at the top of the blade, at the location where these rods were located. These orifices serve in particular as holes for dust removal or for removal of the air present in the cavities of the blade.

Although the present invention has been described by referring to specific exemplary embodiments, it is obvious that modifications and changes can be carried out on these examples without departing from the general scope of the invention as defined by the claims. In particular, individual features of the different embodiments illustrated/mentioned can be combined into additional embodiments. Consequently, the description and the drawings must be considered in an illustrative, rather than a restrictive sense.

It is also obvious that all the features described with reference to a method are transposable, alone or in combination, into a device, and conversely, all features described with reference to a device are transposable, alone or in combination, to a method.

The invention claimed is:

1. A method for manufacturing a ceramic core blank for the manufacture of hollow turbomachine blades using the technique of lost wax casting, the blank being manufactured by additive manufacturing and comprising:

at least one first part for forming cavities of the hollow blades, at least one second part configured to allow positioning of the ceramic core in a wax mold, the at least one second part and the at least one first part being positioned and held with respect to one another by means of a temporary junction portion interposed between the at least one first part and the at least one second part, at least one through orifice extending through the at least one second part, the temporary junction portion and the at least one first part, a first end of the at least one through orifice opening to an outer face of the at least one second part, and a second end of the at least one through orifice opening to an outer face of the at least one first part.

2. The method according to claim 1, wherein the temporary junction portion comprises a passage putting into fluid communication the at least one through orifice and a space outside the core blank.

3. The method according to claim 1, wherein the at least one through orifice comprises a first rectilinear portion extending from the first end, and a second rectilinear portion having an angle less than 180° with respect to the first rectilinear portion, and extending from the second end.

4. The method according to claim 3, wherein the angle between the first and the second rectilinear portion is greater than or equal to 100°.

5. The method according to claim 4, wherein the angle between the first and the second rectilinear portion is comprised between 110° and 120°.

6. The method according to claim 1, wherein a diameter of the first rectilinear portion of the at least one through orifice is comprised between 0.15 and 0.3 mm.

7. A method for manufacturing a ceramic core for the manufacture of hollow turbomachine blades using the technique of lost wax casting, the method comprising a step of manufacturing a blank by the method according to claim 1, and also comprising, after the manufacture of the blank:

cleaning the at least one through orifice, inserting at least one positioning rod into the at least one through orifice, capping the at least one through orifice, eliminating the temporary junction portion.

8. The method according to claim 7, wherein the cleaning of the at least one through orifice is accomplished by an injection of pulsed air and/or a solvent into at least one end of the at least one through orifice.

9. The method according to claim 7, wherein the at least one positioning rod is a rod of alumina.

10. The method according to claim 7, wherein the capping of the at least one through orifice is accomplished by applying a ceramic paste to the two ends of said at least one through orifice.

11. The method according to claim 10, comprising, after capping, a hardening step allowing hardening the ceramic paste used for capping the at least one through orifice.

12. The method according to claim 7, wherein, prior to their insertion, the at least one positioning rod is coated with ceramic adhesive.

13. A method for manufacturing a hollow turbomachine blade using the technique of lost wax casting, comprising:

Manufacturing the ceramic core by a method according to claim 7, manufacturing a wax model having a shape of a final part by arranging the ceramic core obtained in the preceding step in a wax mold, manufacturing a ceramic mold by plunging the wax model obtained in the preceding step several times into a slurry, pouring, after the elimination of the wax, molten metal into the ceramic mold and around the ceramic core, elimination of the ceramic mold and of the ceramic core.

14. A ceramic core blank for the manufacture of hollow turbomachine blades using the technique of lost wax casting, comprising:

at least one first part for forming cavities of the hollow blades, at least one second part configured to allow positioning of the ceramic core in a wax mold, the at least one second part and the at least one first part being positioned and held with respect to one another by means of a temporary junction portion interposed between the at least one first part and the at least one second part, at least one through orifice extending through the at least one second part, the temporary junction portion and the at least one first part, a first end of the at least one through orifice opening to an outer face of the at least one second part and a second end of the at least one through orifice opening to an outer face of the at least one first part.

* * * * *